United States Patent [19]

Bosnjak

[11] 4,119,436

[45] Oct. 10, 1978

[54] SUGAR REFINING PROCESS

[75] Inventor: Milovan Bosnjak, Denver, Colo.

[73] Assignee: Buttes Gas & Oil Co., Oakland, Calif.

[21] Appl. No.: 799,268

[22] Filed: May 23, 1977

[51] Int. Cl.[2] ..... C13F 1/00; C13G 1/02

[52] U.S. Cl. ..... 127/61; 127/15; 127/16; 127/58; 159/47 R; 203/26

[58] Field of Search ..... 127/15, 16, 58, 61; 159/47 R; 203/26

[56] References Cited

U.S. PATENT DOCUMENTS

| | | | |
|---|---|---|---|
| 3,492,205 | 1/1970 | Webber | 203/26 |
| 3,503,433 | 3/1970 | Riva | 203/26 X |
| 3,680,621 | 8/1972 | Giorgi | 127/16 X |
| 3,796,640 | 3/1974 | Boomer | 203/26 X |
| 3,899,386 | 8/1975 | Komiyama | 127/16 X |
| 4,009,045 | 2/1977 | Petri | 127/16 |

OTHER PUBLICATIONS

"Cane Sugar Handbook", by Spencer and Meade, 8th Ed., 159-168, John Wiley & Sons, New York, 1945.

"Beet-Sugar Technology", R. A. McGinnis, ed., 2nd Edition, 366-375, Beet Sugar Devel. Foundation, Fort Collins, 1971.

*Primary Examiner*—Sidney Marantz

*Attorney, Agent, or Firm*—Edwin L. Spangler, Jr.

[57] ABSTRACT

A process for the production of sugar from either sugar beets or cane wherein of the total amount of thin juice processed, only that amount required to produce the vapor needed for the sugar boiling phase and the desired density of thick juice is directly evaporated while the remainder or excess over and above these requirements is recompressed. Essentially only that fraction of the latent heat of vaporization required for process heating is extracted from the already limited amount of vapor employed in sugar boiling by transferring the heat contained in a portion of this vapor to a refrigerant which is then recompressed so as to raise the temperature thereof to a level of approximately 95° C.

8 Claims, 5 Drawing Figures

SUGAR REFINING PROCESS

In the processing of sugar beets, it is a generally accepted fact that the U.S. plants consume about 50 percent more energy than their European counterparts. The reason for this is purely an economic one, namely, the switchover to more modern and less wasteful processing technology involves tremendous capital expenditures which, up to now at least, far outweigh any savings that might be realized through the more efficient utilization of fossil fuels and the like. A part of the problem is, of course, the fact that the complex and expensive existing installations would, for all practical purposes, have to be junked because little of the equipment is compatible with modern day processing techniques. This state of affairs is, however, rapidly changing with fuel prices escalating and sure to go much higher in the very near future, especially with no alternate source of energy due to replace fossil fuels anytime soon.

Cane sugar processing plants are much less vulnerable to the so-called "energy crunch" than the best sugar plants because a by-product of cane sugar manufacture is bagasse which, while it has other uses, could be utilized, and is being used, as fuel. The most vulnerable segments of the industry are the U.S. beet processing companies, most especially those which are not deversified and, therefore, depend solely on the sale of sugar for their survival.

Of the some 120 or so sugar processing plants located in the United States, upwards of 50 of them are beet sugar producers highly dependent upon fossil fuels. To give some idea of the magnitude of the problem, a medium sized beet sugar refinery must evaporate in the neighborhood of 14,400,000 pounds of water each day. Translating this into terms of fuel consumption, such a plant would use 72,000 gallons of fuel oil per day. If, therefore, the fuel consumption in all such plants here in the U.S. could be reduced by even 10%, it would result in a tremendous saving in fuel.

It has now been found in accordance with the teaching of the instant invention that, not 10%, but as high as a 50% saving in fuel consumption can, theoretically at least, be realized here in the U.S. based upon current refining particles while, at the same time, greatly simplifying the existing process. The initial step would be one of modifying the evaporation/concentration step by eliminating the commonly used multiple-effect evaporator and to more completely and efficiently utilize the heat present in the condensates. This step alone would reduce by one-third the current energy requirements in this initial stage of the refining process.

The rest of the potential saving would be realized in the final step in the process where the sugar liquor is boiled and crystallized. Here, by proper utilization of the waste heat contained in the vapors generated during the sugar boiling/crystallization step, an additional 15% to 20% energy saving is possible based upon current practices prevalent here in the United States.

Incident to these savings, but nonetheless important, are the accompanying reduction in pollution problems, (cooling water, fly ash, dust, $SO_2$, $NO_x$, etc.) along with the associated operating costs and reduced capital requirements. For instance, it is estimated that the capital required to convert an existing gas or oil-fired steam boiler to coal, when taking into account the necessary anti-pollution accessories, would be just about equal to the cost of a new system of the type forming the subject matter hereof. In other words, since the sugar producers in this country are already faced with the reality of having to convert their gas or oil-fired boilers to a locally available source of energy (coal), the real answer is to go all the way and, while making the changeover, redesign the process to save half the energy input, regardless of its form.

The improved sugar refining process described herein has still other significant advantages. For instance, it is not some exotic "far out" process requiring specially fabricated process equipment, but instead, it uses standard industrial type compressors, evaporators, heat exchangers and the like which are, basically, off-the-shelf items available anywhere.

Best of all are the economics. It is reliably estimated that the first phase equipment costs for a standard 2400 ton/day would run about $1,200,000 with another $600,000 for installation. Even based upon current oil prices, the resultant annual savings should amount to at least $750,000 and, perhaps, as high as $900,000. Looking at these figures conservatively and allowing for a 20% over expenditure in equipment and labor, at the lesser $750,000 projected annual saving, this still amounts very close to a 35% return on investment which is hard to beat.

The second phase changeover should run a total of not more than about $1,300,000 including both material and labor with a resultant annual saving projected as amounting to around $450,000. This, too, promises about the same excellent return on investment.

Current technology here in the United States does not even represent the highest state of the art in sugar refining, thus, the beet and cane sugar plants here present an opportunity for vast improvement as has just been pointed out. Instead, one must look to Europe, and particularly to the Swiss, for the best the art has yet to offer. As far as applicant is aware, the closest and most advanced prior art is currently in use in a refinery in Aarberg, Switzerland, the technology of which will be discussed in detail presently in connection with a detailed description of the instant invention. Comparisons will also be made with plants involving existing U.S. technology and, most important, with a hypothetical plant, the energy consumption values in which are predicated upon theoretical optimum conditions.

Accordingly, it is the principal object of the present invention to provide a novel and improved process for the production of sugar from either sugar beets or cane.

A second objective of the within described invention is the provision of a process of the type aforementioned which results in substantial savings in energy.

Another object is to provide a sugar refining process wherein much of the existing equipment in use here in the U.S. continues to be utilized.

Still another object is the provision of a sugar refining process in which, while substantial capital investments are called for, they by no means approach the cost of a new plant and, most significant, they conservatively appear to result in an annual return on investment of better than one-third.

An additional object is to provide an improved process of the type forming the subject matter hereof wherein the pollutants in the form of heat, particulate matter and noxious gases and vapors are materially reduced.

Further objects are to provide an energy saving process for refining sugar which is simple, economical, efficient, versatile, easy to operate and utilizes standard commercially available equipment.

Other objects will be in part apparent and in part pointed out specifically hereinafter in connection with the description of the drawings that follows and in which:

Figure 1:
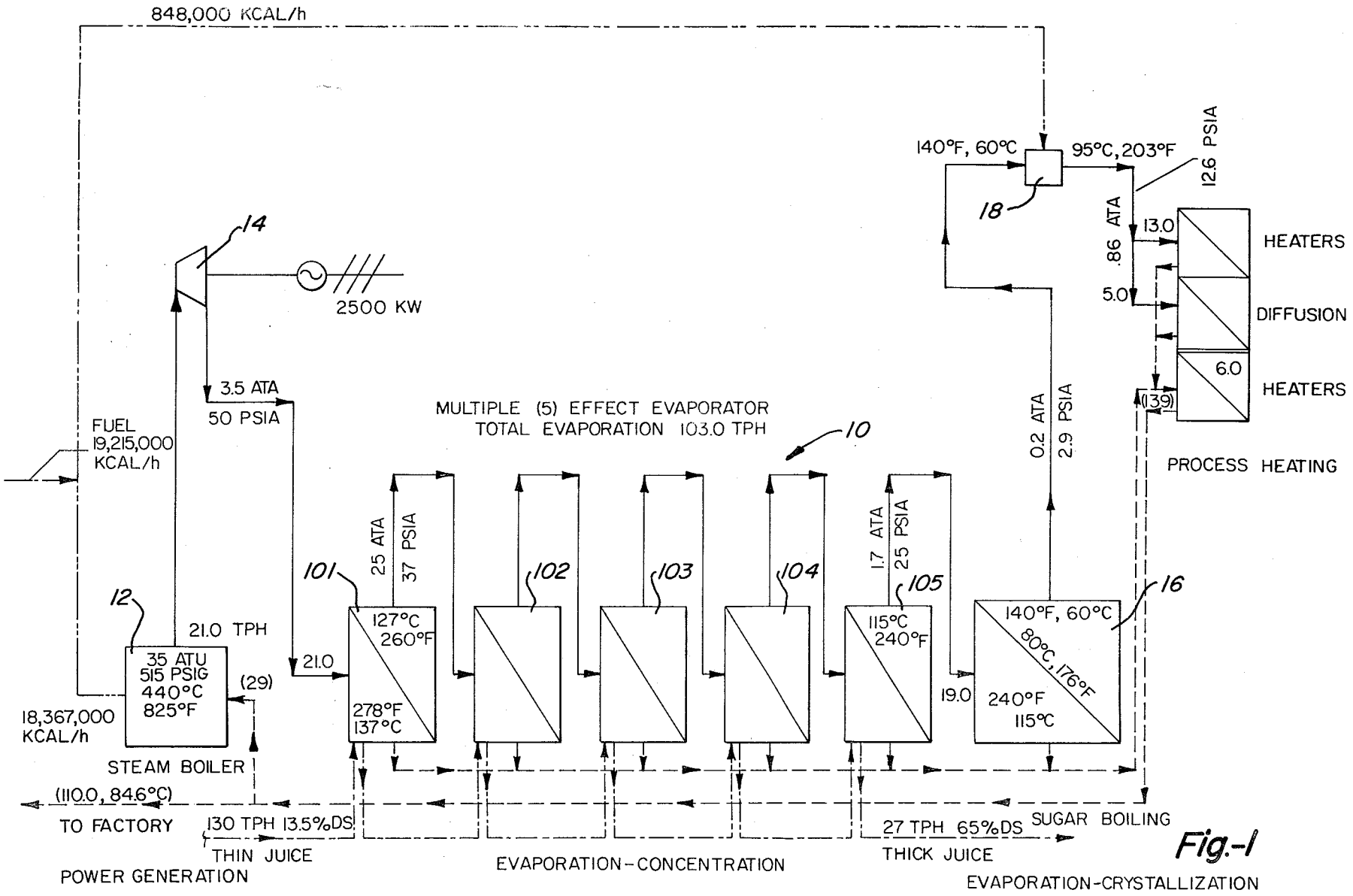
FIG. 1 is a schematic view showing a hypothetical sugar refinery showing the theoretical optimum energy requirements thereof.

Since, in the material which follows, much attention will be given to comparative energy requirements between different sugar refining processes, a common data base is needed because, without one, the comparisons to be made become difficult to evaluate. Therefore, in the presentation which follows, the following parameters have been chosen as constant:

1. Production Capacity, 100 tons per hour of standard quality beets, standard white sugar production.
2. Electrical Power requirements, 2,500 kW.
3. Evaporation requirements in the concentration stage, 103.0 tons per hour.
4. Evaporation requirements in the crystallization stage, 18.0 tph.
5. Process heating requirements, equivalent to 24.0 tph of evaporation.
6. Steam boiler efficiency, $n = 0.80$.
7. Boiler feed water at 100° C.

Before proceeding with a detailed description of the present invention, a much better understanding thereof will be possible if initial consideration is given to a hypothetical plant, the energy consumption values in which are based upon theoretical optimum values. The plant illustrated in FIG. 1 to which detailed reference will now be made is just such a hypothetical plant. It will be seen to include a standard multiple-effect evaporator that has been indicated in a general way by numeral 10 and which in the particular form shown has five effects, 101, 102, 103, 104 and 105. The purpose of this evaporator is the concentration of the so-called "thin juice" extracted from the beet pulp.

In the refining process itself, the first phase which calls for the use of energy is the generation of process steam in boiler 12. The heat of combustion of the fuel, be it oil, coal or gas, is used to evaporate water in the boiler to produce steam at the desired temperature and pressure. As shown, the make-up steam is at 440° C. and a pressure of 35 atmospheres. While steam boilers generally can be relied upon to convert the fuel energy to steam with a conversion efficiency of better than 80%, nevertheless, for the purpose of arriving at a theoretical optimum heat conversion figure, it will be assumed that a 20% loss occurs at the steam generation stage.

The next aspect of the energy conversion analysis that needs to be considered concerns itself with the conversion of a portion of the energy in the steam to electrical power. Here the potential energy in the steam would be converted to electrical energy in back pressure turbogenerators 14. Based upon standard efficiencies and steam rates while accounting for the equivalent energy loss, it can be seen that over four million kilocalories per hour are needed to produce 2500 kilowatt hours of electrical energy as follows:

$$(2500 \times 860)/(0.63 \times 0.8) = 4{,}278{,}000 \text{ kcal/hr}$$

The energy consumed in the evaporative process is responsible for both the concentration of the thin juice to form so-called "thick juice" and the crystallization of the sugar from the thick juice after it has undergone certain preliminary processing which is of no importance here. The formula used to calculate the work of evaporation (E) which is the only loss, other than the loss to the environment, that results in energy consumption while concentrating the thin juice, is as follows:

$$E = Q\left(\frac{T}{T_{\cdot}} - \frac{T}{T_{\cdot} + \Delta T}\right)$$

where:

$Q = 1$,
$T_0 = 20°$ C.,
$T_2 = 115°$ C.,
$\Delta T = 22°$ C., and
$E = 0.0405$, or the total heat transfer loss is only 4.0 percent of the input energy.

The total evaporation in the five effects of evaporator 10 amount to 103.0 tph. Vapor from the last of the five effects, 105, could, if desired, be used for further evaporation during the crystallization stage being carried out in evaporator(s) 16 and, ultimately, the vapor generated in the latter could be employed for process heating.

In the portion of the evaporative process wherein the sugar solution or liquor is heated, boiled and crystallized, the maximum safe temperature is generally considered to be 128° C. Sugar boiling takes place at around 80° C. and this stage of the process is normally carried out between 75° C. and 85° C. Ordinarily, heating steam at approximately 115° C. is used for crystallization and, while it is certainly possible to run the five-effect evaporator 10 so as to meet these requirements, to do so would require very large heat transfer surfaces. As a matter of fact, at the sugar boiling stage, it would be virtually impossible to evaporate anything within the prescribed limits, i.e. heating steam at 115° C. and generated vapor at 95° C. Even if one could raise the boiling temperature up to say 100° C., the high density of the liquor (90 percent dissolved solids) results in the boiling point being elevated almost 20° C., therefore, no vapors at 95° C. could be generated at all. Actually, in practice, sugar boiling takes place in boiler(s) 16 at 80° C. and the vapors produced have a temperature of only about 60° C. Therefore, to bring their temperature up to 95° C. would require some additional work supplied in heat exchanger 18, which could be calculated as:

$$W = Q\left(\frac{T}{T} - \frac{T}{T}\right) = Q\left(\frac{293}{368} - \frac{293}{333}\right) = -Q \times .0837$$

Based upon the foregoing, it would seem that the quantity of steam generated in the steam boilers 12 has to be such as to satisfy the process heating requirements, (in this case equivalent to 24 tph of evaporation), and cover the losses to the environment, (in this case equivalent to 3%). Accordingly, for the process heating we need 24,000 × 540 = 12,960,000 kcal/hr and to cover the heat losses 12,960,000 × 0.03 × 540 = 404,000 kcal/h which gives a total of 13,364,000 kcal/hr. That amount of energy plus 20 percent to cover the losses due to boiler inefficiency, (13,364,000: 0.8 + 2,700,000 = 16,705,000) would be sufficient to cover all processes heating requirements. Thus, adding everything up, the total energy requirements would be:

$$4{,}266{,}000 + 525{,}000 + 1{,}769{,}000 + 16{,}705{,}000 = 23{,}265{,}000$$

less the heat equivalent recovered from condensates at (6,000 × 540): 0.8 = 4,050,000 or $$23{,}265{,}000 - 4{,}050{,}000 = 19{,}215{,}000 \text{ kcal/hr}$$

Having had a general look at the energy requirements for the FIG. 1 plant, it would be helpful to take a described look at the calculations upon which these figures were based. The theoretical energy requirements for a sugar plant, capacity 100 tph, according to the schematic of FIG. 1 are as follows:

1. Process heating
   24,000 × 540 = 12,960,000 kcal/h
   3% loss = 404,000 kcal/h
   Total = 13,364,000 kcal/h = $Q_1$
2. Evaporation-concentration
   $533 \times 19{,}000 \times \left(\frac{293}{388} - \frac{293}{410}\right) = 410{,}000$ kcal/h
3. Evaporation-crystallization
   a. Work lost under processing conditions
      $19{,}000 \times 533 \times \left(\frac{293}{333} - \frac{293}{388}\right) = 1{,}263{,}000$ kcal/h
   b. Work input necessary to bring the vapor from 60° C. to the desired temperature of 95° C.
      $18{,}000 \times 563 \times \left(\frac{293}{368} - \frac{293}{333}\right) = 848{,}000$ kcal/h
4. Electrical power
   2,500 × 860 = 2,150,000 kcal/h Total theoretical energy requirement:

1. 13,364,000
2. 410,000
3. 848,000
4. 2,150,000

16,772,000 kcal/h

Energy requirements taking into account efficiency of the equipment available:

1. Process heating - $Q_1$ = 13,364,000 represents total heat required to cover all losses, inefficiency of the equipment and process requirements.
2. Evaporation-concentration - overall efficiency of a five-effect evaporation is very good; n = 0.98, $Q_2$ = 420,000 kcal/h.
3. Evaporation-crystallization - the best way to raise the temperature of the vapor would be by compression; an overall efficiency (compressor and a drive) of n = 0.60 would be adequate, $Q_3$ = 1,415,000 kcal/h.
4. Electricity generation - overall efficiency n = 0.63, $Q_4$ = 3,412,700 kcal/h.

Total of 1 + 2 + 3 + 4 = 18,612,000 kcal/h
Deducting heat recovered from condensates 3,240,000 kcal/h gives a total of 15,372,000 kcal/h.
Including the boiler, n = 0.80, $Q_7$ = 19,215,000 kcal/h.

Since recompression evaporators are known to be superior to the multiple-effect type currently in use in the sugar refineries found here in the U.S., and also because a system based upon the use of thermorecompression has apparently been operated successfully for some time in Europe, it behooved applicant to evaluate a system like that shown in FIG. 2 to which detailed reference will now be made and in which evaporator 10 of FIG. 1 has been replaced by a thermocompression unit 20 and a single stage evaporator 22. A thermocompression evaporator has a theoretical efficiency equivalent to over 40 effects with a practical efficiency calculated on the basis of input energy which ranges somewhere between the equivalent of from 10 to 40 effects. A single thermocompression unit, therefore, is capable of doing the same job as a four or five-effect up to as much as a thirty-effect, multiple-effect evaporator. Also, since no heat of condensation losses occur in a back pressure turbine, its use is recommended for driving the compressor. In so doing, high pressure steam would be utilized with the result that a certain amount of low pressure steam would ultimately result and could be put to use in further processing.

Figure 3:
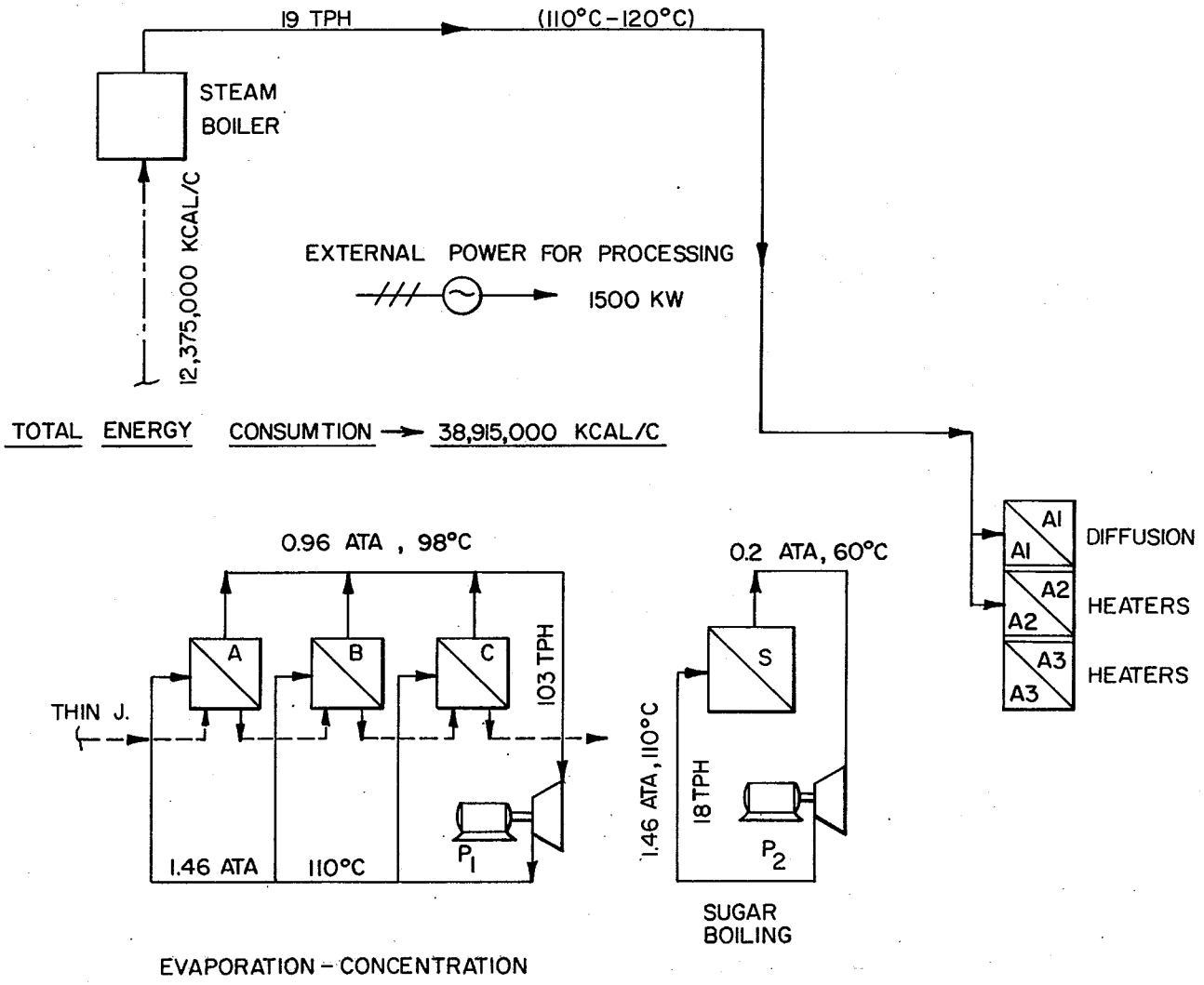
Fig-3 (PRIOR ART)
FIG. 3 is a schematic showing the state of the art with respect to a recompression evaporative system of the type applicant believes is being used in the plant in Aarberg, Swizterland.
Figure 4:
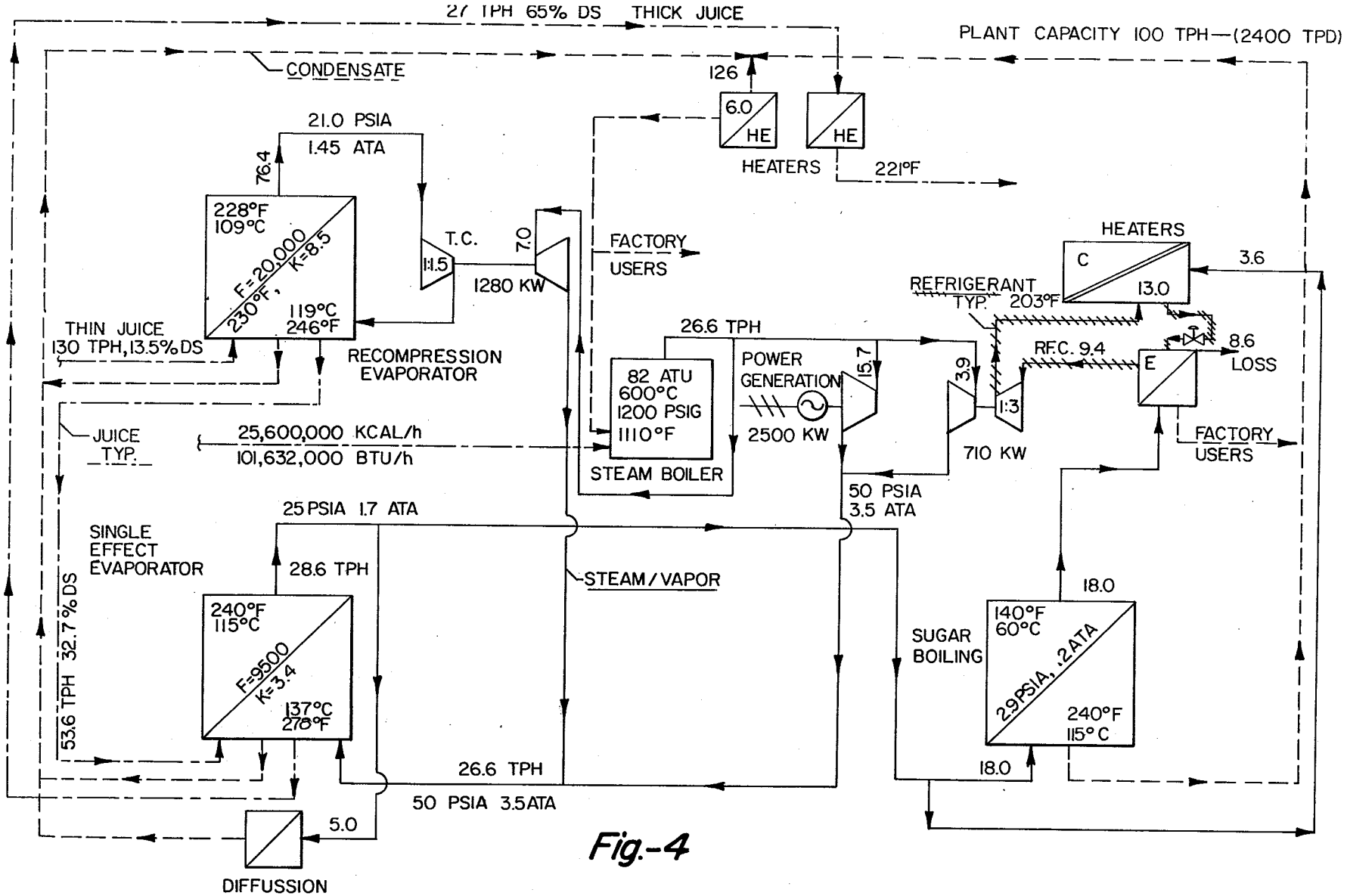
FIG. 4 is a schematic showing the processing plant of FIG. 2 modified for optimal operation in accordance with the teaching of the instant invention; and, FIG. 5 is a schematic like FIGS. 2 and 4 providing a basis for a generalized look at the energy requirements of the system and the best way of conserving same.

Unexpectedly, however, the calculations reveal that if all the evaporation/concentration of the thin juice is accomplished solely through thermocompression (103.0 tph) and all of the sugar boiling vapors (18.0 tph) are recompressed and reused for process heating, the total energy requirements would far exceed the 25,600,000 kcal/hour found on the heat balance schematic of FIG. 4 because of several factors. For instance, if the overall compressor efficiency were only 0.80 and the heat transfer efficiency is 0.95, straight heat transfer can be accomplished through the use of less energy than recompression. This occurs because of the inefficiencies inherent in mechanical devices like the compressors, drives, etc. For these same reasons, the system of FIG. 2 is superior to that of FIG. 4. The fact remains, however, that thermorecompression units are, in fact, better than multiple-effect evaporators and the key, therefore, must lie in utilizing them to their best advantage. It behooves us to examine, therefore, the only system known to applicant which employs recompression evaporative techniques for the refining of sugar from sugar beets. Such a system has been illustrated schematically in FIG. 3 to which detailed reference will now be made. This schematic, to the best of applicant's ability, represents the system in use in Aarberg, Switzerland. Certain key features stand out in the Aarberg process which are worthy of particular note.

First of all, the Aarberg system of FIG. 3 uses total 100% recompression of vapors at the concentration stage (A, B and C), 100% direct recompression for sugar boiling (S), and low pressure steam from the boilers is used for process heating. As will appear presently, these factors alone contribute to about a 20% greater energy consumption over that which forms the subject matter of the instant invention and to which detailed reference will soon be made in connection with FIG. 4.

It will also be shown that the Aarberg process calls for recompression of some 26% more vapor simply because the entire input of amount of water in the sugar bearing extract undergoes recompression. The result of this is to end up with a denser more concentrated product which requires a greater temperature differential to evaporate due to the less efficient heat transfer characteristics of such an aqueous mixture.

Looking next at the sugar boiling phase of the Aarberg process, it calls for raising the temperature of the resulting vapor all the way up to 110° C. which is a ΔT of 50° C. This operation involves very large and expensive compressors, a great deal of power, and huge evaporation surfaces.

Lastly, direct recompression requires very clean steam and, therefore, very efficient entrainment separators are needed in the Aarberg process of FIG. 3.

It has now been found in accordance with the teaching of the instant invention that it is not the use of recompression evaporative techniques in sugar refining that can be relied upon to produce a saving in energy because, frankly, they do not. Instead, it is the improved manner of using it (recompression evaporation combined with a single-effect evaporator) which, unexpectedly, produces a very significant improvement and reduction in overall energy requirements.

FIG. 4 to which reference will now be made shows in schematic form the improved process of the present invention which employs recompression evaporation at the concentration stage along with conventional single stage direct evaporation combined in a unique way to bring about a 30% savings in energy requirements.

To being with, rather than recompressing 100% of the vapors as was the case in the Aarberg process, only that proportion is recompressed which is left over after it has been determined what fraction thereof is needed for sugar boiling (and supplemental heating). The other determinative parameter is the desired density of the thick juice remaining after concentration of the sugar boiling liquor (thin juice) inputed to the system. In other words, if the system is being operated such that the thick juice issuing from the concentration stage of the process is to have, say 65% fixed solids, then the recompression evaporation step must be carried out until this condition exists. Significantly, by so doing, a smaller temperature differential is needed (10° C. instead of 12° C.) because the product is less dense and possesses better heat transfer characteristics. As illustrated, based upon our 100 tph plant, the instant system need only recompress 76 tph of the input, not 103 tph as would be the case with Aarberg.

Recompression by itself is not enough because it must be combined with and supplemented by direct evaporation of the water contained in that quantity of sugar beeting extract which was, in effect, set aside for further processing. In the system illustrated, of the 103 tph of vapor available from the 130 tph of extract entering the system, it was estimated that 18 tph was going to be needed to generate the vapors required for the sugar boiling phase and 8.6 tph for supplemental heating, therefore, all but this 26.6 tph (76.4 tph) is subjected to recompression. This remaining 26.6 tph uses available steam to evaporate it and as high a $\Delta T$ as is necessary, therefore, the final concentration takes place at a higher temperature and a greater $\Delta T$ than the initial recompression concentration phase. To do so, requires a smaller evaporation surface, a much smaller compressor and, of course, a good deal less power.

Looking further to the sugar boiling phase, instead of trying to raise the temperature of all the vapor back up to 110° C. from 60° C. (a $\Delta T$ of 50° C.) which requires the use of large compressors, evaporation surfaces, etc., as previously noted, only so much of the vapor as is actually needed for process heating is passed in heat exchange relation to a refrigerant which is then recompressed and its $\Delta T$ raised to 95° C. which is ample for process heating. The resulting $\Delta T$ of only 35° C. requires one-third less energy than the 50° C. $\Delta T$ employed in the Aarberg process. Actually, the instant system involves only about 30% of the capital investment present in the Aarberg system because, among other things, refrigeration systems are far less expensive than high $\Delta T$ steam compressors.

It should also be noted that direct recompression requires very clean steam and, therefore, very efficient entrainment separators are required in the Aarberg process. Conversely, in the instant process, the foregoing problem is completely eliminated due to the use of indirect means for raising the temperature and transfer of heat.

Accordingly, it can be seen that the instant system shown schematically in FIG. 4 has a three-fold advantage over the best that the prior art has to offer, specifically:

(1) Lower overall energy consumption.

(2) Lower operating costs; and, (3) Lower initial capital investment.

Figure 2:
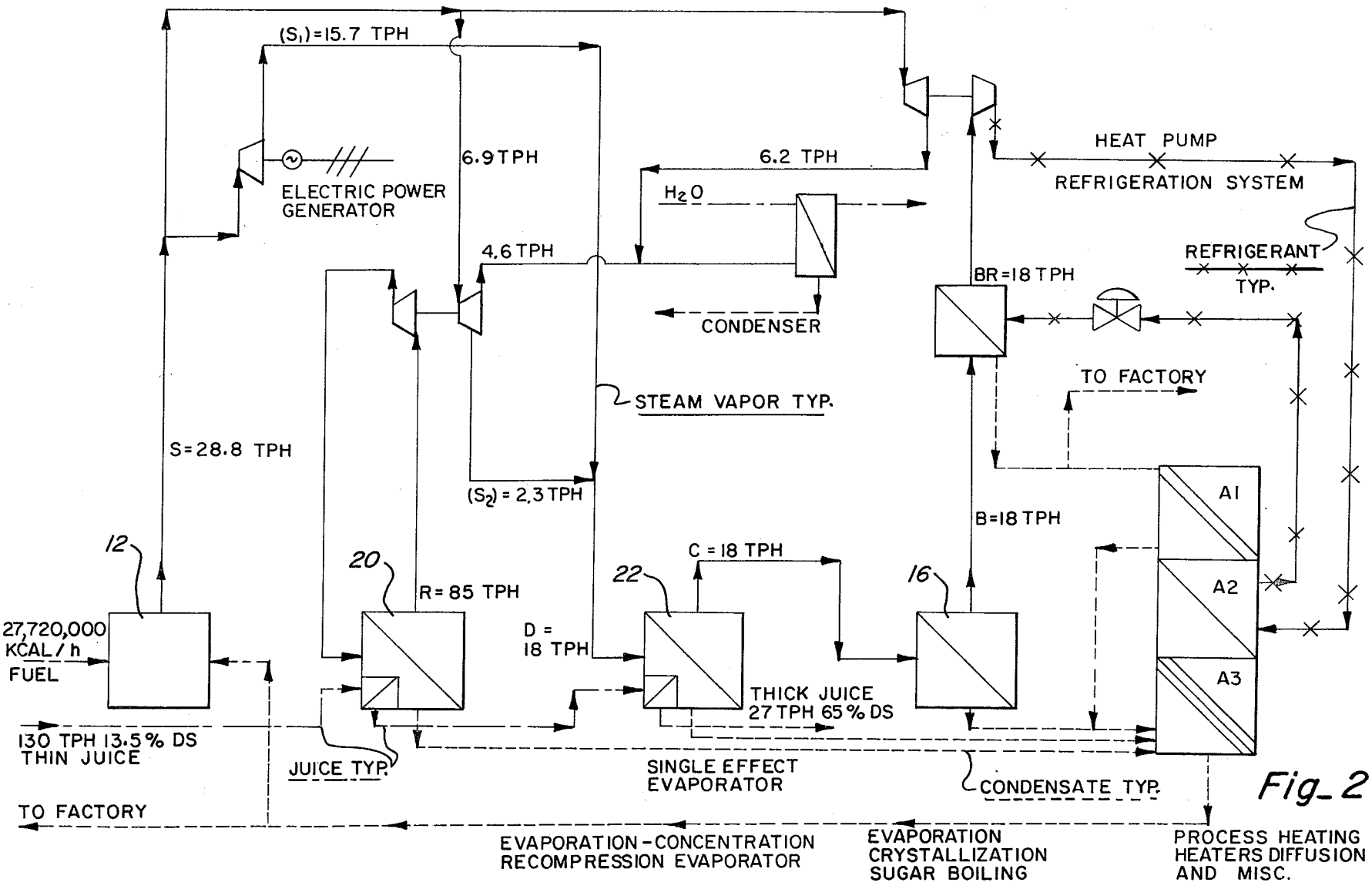
FIG. 2 is a schematic view comparing the hypothetical plant of FIG. 1 with a similar plant using a recompression evaporator in place of a multiple-effect one.
Figure 5:
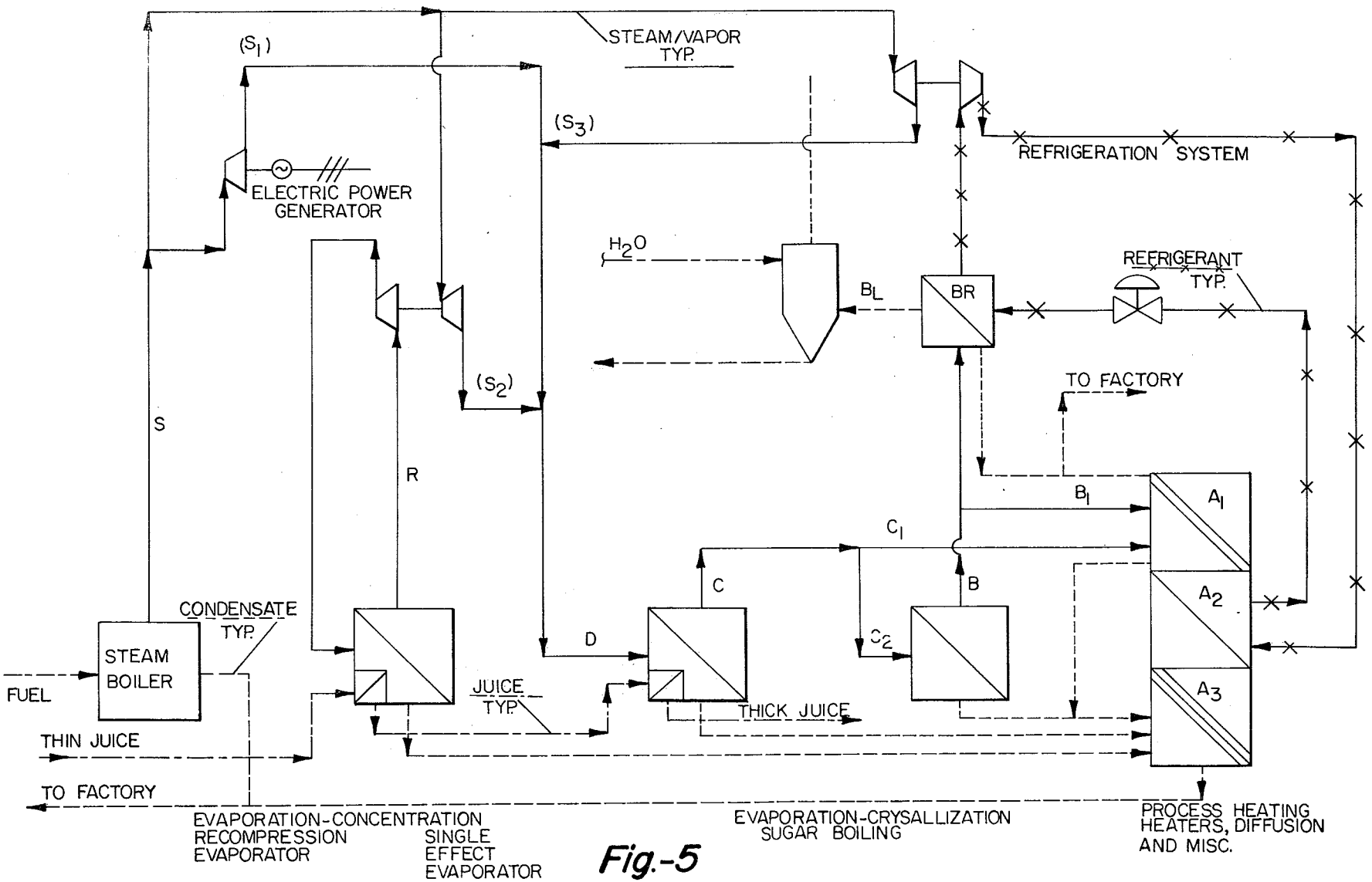

Finally, with particular reference to FIGS. 2, 4 and 5, certain important relationships are ascertainable. Steam boiler generates steam at 600° C. and 82 ATU. The total steam consumed D is represented by the relationship:

$$D = S_1 + S_2 + S_3$$

when $S_1$ = the steam consumed for power generation at 15.7 tph $S_2$ = the steam consumed in concentrating the thin juice at 7.0 tph, and $S_3$ = the steam consumed for refrigeration at 3.9 tph.

In the evaporation/concentration phase of the process, the total water evaporated W consists of that amount R evaporated in recompression evaporator RC and the additional amount C evaporated from single-effect evaporator DE and this total is constant. Thus:

$$W = R + C = CONST. = 103.0 \text{ tph}$$

In the crystallization stage, an additional amount of water B is evaporated from evaporator S and quantity B is also constant, therefore:

$$B = CONST. = 18.0 \text{ tph}$$

The total process heating requirements A are represented by the sum of $A_1$, $A_2$ and $A_3$, thus:

$$A = A_1 + A_2 + A_3$$

A certain amount of heat $B_R$ is recovered by refrigeration and, as shown on the schematics, this is $A_2$. Accordingly:

$$B_R = A_2$$

The total heat consumption C is equal to the total steam consumption D and also the sum of the heat consumed in the process heater ($A_1$) represented by the term $C_1$ and that $C_2$ consumed in evaporator DE, expressed mathematically as follows:

$$D = C = C_1 + C_2$$

however, $$C_2 = B_R$$

therefore, $$D = C = C_1 + B$$

As noted before:

$$A = A_1 + A_2 + A_3$$

which, in turn equal $$C_1 + B + B_R + A_3$$

where $B_1$ is the fraction of B (FIG. 5) from evaporators that enters heater $A_1$. Thus, $$C_1 = A - A_2 - B - B_R$$

and, $$D = A + B - A_3 - B_1 - B_R$$

if $$A + B - A_3 = Q = CONST.$$

then $$D = Q - B_1 - B_R$$

and $$B = B_1 + B_R + B_l$$

where $B_L$ = the heat lost in condensation if $$B_1 = B_l = 0$$

then $$B_R = B$$

and $$D = A - A_3 \text{ or}$$

the total steam consumed should equal the process heating requirements of heaters $A_1$ and $A_2$.

For a self-contained system, the best results are obtained if the following balance exists:

$$S_1 + S_2 + S_3 = C_1 + B \text{ (Assuming } B_1 = 0)$$

thus, $$S_1 = K_1 \times R$$

$$S_2 = K \times B_R \text{ and}$$

$$R = W - (C_1 + B)$$

Where $K_2$ is the Recompression ratio of recompressed vapor vs. compressor consumption in a back pressure turbine and $K_2$ is the refrigeration ratio.

For the given conditions:

$$B = 18.0 \text{ tph}, A_3 = 6.0 \text{ tph}$$

$$A_1 + A_2 = 18.0 \text{ tph}$$

$$S_1 = 15.7 \text{ tph}, K_2 = 0.0915 \text{ of live steam/1 kg (of vapor)},$$

$$K_1 = 0.41 \text{ kg/kg}$$

$$W = 103.0 \text{ tph}$$

$$S_1 + K_1 \times [W - (C_1 + B)] + K_2 \times B_R = C + B$$

$$S_1 + K_1 \times W - K_1 \times C_1 - K_1 \times B + K \times B_R = C + B$$

$$C_1 = A_1 + A_2 - B_R = 18 - B_R$$

$$S_1 + K_1 \times W - 18 K_1 + K_1 B_R - K_1 B + K B_R = B - B_R + 18$$

$$B_R(1 + K_1 + K_2) = 18 + B(1 + K) + 18 K_1 - K_1 W - S_1$$

Substituting $$B_R = 14.17 : 1.5015 = 9.4 \text{ tph}$$

And $$C_1 = 18 - 9.44 = 8.6 \text{ tph}$$

$$R = 103 - 8.56 - 18 = 76.4 \text{ tph}$$

$$B_l = B - B_R = 18 - 9.44 = 8.6 \text{ tph}$$

$$S_2 = 7.0 \text{ tph}, S_3 = 3.9 \text{ tph}$$

$$S = 15.7 + 7.0 + 3.9 = 26.6 \text{ tph}$$

FIG. 5 enables one to determine the optimum heat balance for any given set of conditions. For instance, from the relationship:

$$S = D = (A + B) - (A_3 + B_1 + B_R)$$

one can see that the energy consumption for the system could be reduced if it were possible to:

(1) Improve the recovery of the heat from the condensates ($A_3$).

(2) Maximize the recovery of the heat from the vapors generated during the sugar boiling ($B_1$ and $B_R$).

(3) Minimize the process heating requirement (A) and sugar boiling requirements (B).

Unexpectedly the amount of water to be evaporated during the concentration (W) is not playing an all important role as is the case with the prior art systems. If calculated back from $S_2 = K_2 \times R$ and going to the input energy units;

To evaporate one kg of water 540 kcal are needed — * the adiabatic enthalpy drop from 82 ATU, and 600° C. to 3.5 ata and 137° C. amounts to 218 kcal/kg Specific steam consumption $K_2$ = 0.0915 kg/kg and 540 : (0.0915 × 218) = 30.1 kg/kg which means that by producing one extra kg (lb) of steam at the boilers it becomes possible to evaporate 30 kg (lbs) of water using the recompression evaporator, instead of only 2.6 as can be shown to be the case with a system using a four-effect multiple-effect evaporator.

Moreover, since the fluctuations are generally quite small, the process disturbances could be handled with only slight capacity changes at the boilers, say on the order of 1 to 2 percent.

For existing plants having low pressure steam boilers, it is entirely possible to drive the compressor(s) using electric power instead of steam turbines. For example:

$$A_1 + A_2 = 18 \text{ tph}, B = 18 \text{ tph}$$

$$S = S_1 = K \times 2500 \text{ kWh}$$

At 21 ATU (370 psig) and 400° C. (750° F.)

$K = 11.0$ kg/kWh, $S = 27.5$ tph $C = S - B = 27.5 - 18.0 = 9.5$ tph $B_1 = A = A - C = 18 - 9.5 = 8.5$ tph $R = W - D = 103.0 - 27.5 = 75.5$ tph Recompression power $P = 75.5 \times 16.7 = 1{,}260$ kW Refrigeration power $P = 8.5 \times 75.3 = 640$ kW Taking into account the efficiency of an electric generator ($n = 0.63$) and a steam generator/boiler ($n = 0.80$), energy required to generate 1,260 + 640 = 1,920 kW would be:

$(1{,}920 \times 860) : 0.504 = 3{,}276{,}190$ kcal/h and to generate 27.5 tph of steam at 21 ATU and 400° C.

$(27{,}500 \times 675) : 0.8 = 23{,}203{,}125$ kcal/h or a total of 26,479,315 kcal/h
which is much less than that required in the prior art processes using multiple-effect evaporators or the Aarberg process.

Even without refrigeration:

$D = B + C = 18 + 18 = 36.0$ tph $R = W - D = 103 - 36 = 67$ tph

Total power generated $36{,}000 : 11 = 3{,}272$ kWh

Electricity consumers 2,500 kWh and 773 kWh remaining.

$P = 67.0 \times 16.7 = 1{,}120$ kW required

The difference of 347 kW could be supplied from an outside source at an energy input of:

$(347 \times 860) : 0.504 = 592{,}000$ kcal/h

For the steam:

$(36{,}000 \times 675) : 0.8 = 30{,}375{,}000$ or a total of 30,967,000 kcal/h
Refrigeration efficiency:

An input of $(3900 \times 218) : 0.8 = 1{,}062{,}750$ kcal recovers $9{,}400 \times 540 = 5{,}076{,}000$ kcal which gives an efficiency of 4.8. Accordingly, the systems as shown in FIG. 4 promises to be the best practical solution because its energy consumption of 25,600,000 kcal/h comes closest to the optimum value of 19,215,000 kcal/h determined in the theoretical optimum of FIG. 1.

Thus the requirements of the optimum system would be to:

A. 1. Generate only so much steam as is needed to satisfy the process heating requirements and inevitable heat losses to the environment; and, 2. Bring the steam to an energy level (pressure and temperature) sufficient to generate enough power to satisfy all power consumers (in our case, FIG. 4., 2,500 kW for electricity, 1,280 kW for recompression evaporation and 710 kW for the refrigeration cycle — total of 4,490 kW) while leaving a sufficient energy potential so it could be utilized again (in our case — saturated steam at 3.5 ATA and 137° C.)

B. Use a mechanical recompression evaporator for the evaporation-concentration (instead of a multiple-effect evaporation) to preconcentrate the juice. Final concentration will take place in the single-effect evaporator heated by the exhaust steam.

C. 1. Use all of the exhausted steam, after passing through the turbines, for final evaporation/concentration in a single-effect evaporator, and 2. Generate enough of secondary vapor at an adequate temperature to satisfy the sugar boiling requirements (in our case — 18.0 tph at 115° C.).

D. Elevate the temperature of vapors generated during the sugar boiling to a temperature suitable for an efficient heating during the processing; however, only the quantities really needed. In our case, only 9.4 tph from 60° C. to 95° C.

E. Use a "refrigeration" system to raise the temperature of the vapors generated during the sugar boiling. Note: While it appears that the cost for a refrigeration system would be considerably lower than the investment for straight vapor compression equipment, i.e. for that temperature difference and vapor volumes involved, a direct recompression unit is not excluded.

F. Use all of the available sensible heat from the condensates and use it directly without any expansion/-flashing.

From the foregoing, it should be apparent that the instant system brings about reduced energy consumption; about 20 percent to 30 percent from the best operating systems. Also, the reduced energy consumption will require less in the way of steam generating capacities and correspondingly less pollution abatment equipment. The process is considerably simpler due to simplification of the entire heat distribution system (only one vapor for sugar boiling and other services, only three condensates and only one separate "refrigeration" system).

Moreover, the system is very stable and usual variations of the feed quality and quantity could be easily compensated for by the action of the recompression evaporator. Also, it can be one of only minimal extra capacity and still handle the maximum variations usually encountered. For instance, it is not unusual to find that quantity of water to be evaporated increases from say 103 tph to 110 tph. To evaporate the difference in a prior art multiple-effect evaporator system, several tph of steam would be required, and the whole system would go off balance for awhile because it would not be easy to find some extra consumers for that increased vapor production (7.0 tph, 6.8%).

The instant system, on the other hand, is using only (7.0:76.4)=0.0915 tph of steam to evaporate 1 tph of water. Thus to evaporate 7.0 tph it would require $7 \times (1-0.0915) \times 0.0915 = 0.58$ tph of steam and the excess vapor would amount to only 0.58 tph or 0.56% which can be considered negligible.

The sugar end operation should be very smooth because the thick juice density could be continuously and effectively kept within prescribed limits. The refrigeration system coupled with a condenser is very flexible since all steam consumption variations and evaporation rate changes could be handled effectively and without any significant process disturbances.

It should be noted that it is not necessary to use the live steam exclusively for the power generation because any power source, external or internal, could be used to drive compressors for the recompression evaporator and the refrigeration system. If this were done, the economy would not be as good but still much better than with the prior art systems.

Falling film type evaporators are recommended; particularly plate-falling film types, if one is to take full advantage of the recompression.

As far as the recompression evaporator itself is concerned, it should be operated at temperatures between 100° C. and 125° C. in order to reduce the specific volume of vapors, improve heat transfer by lowering the viscosity and remain within safe temperature limits. One of its advantages would be the possibility of altering the operating temperature in accordance with existing conditions and without interfering with the rest of the plant.

As an adjunct to the process, softening/decalcification of the thin juice is recommended because it would improve the heat transfer, assure steady capacity during the campaign and improve the overall efficiency.

The final evaporator should work at temperatures between 110° C. and 125° C. in order to provide adequate vapors for the sugar boiling, improve heat transfer and remain below safe temperature limits. Lastly, the system could be implemented in stages because its two main parts (recompression and refrigeration) are completely independent of one another.

What is claimed is:

1. In a process for refining sugar wherein an aqueous sugar bearing extract of the latter is concentrated to produce a concentrate having a preselected percentage of fixed solids and the sugar is crystallized by boiling a solution thereof using a predeterminable quantity and quality of steam as the source of heat, the improvement which comprises: estimating what proportion of the total amount of water contained in the sugar bearing extract entering the process is needed to satisfy the steam requirements of the sugar boiling phase thereof upon being evaporated, evaporating and recompressing the excess of the water contained in the sugar bearing extract over and above said proportion thus estimated in a recompression evaporator, and evaporating in a single effect evaporator the water contained in said proportion left over after the water contained in the remainder of the sugar bearing extract has been recompressed under conditions capable of producing steam of the quality and in the quantity predetermined as necessary to carry out the sugar boiling.

2. The sugar refining process as set forth in claim 1 which includes the further steps of estimating the process heating requirements, predetermining what proportion of the total vapors generated during said sugar boiling phase must be processed to satisfy said process heating estimate, passing said proportion of the vapors generated during sugar boiling in heat exchange relation with a refrigerant so as to transfer said estimated quantity of heat thereto, and recompressing said refrigerant to raise the temperature thereof.

3. The sugar refining process as set forth in claim 1 wherein the sugar bearing extract is evaporated and recompressed to a point when the percentage of fixed solids left therein does not exceed approximately 70%.

4. The sugar refining process as set forth in claim 1 wherein the temperature differential used to accomplish the evaporation and recompression of said excess of the sugar bearing extract is maintained at a level substantially less than that required to evaporate and recompress the entire input of said extract.

5. The sugar refining process as set forth in claim 2 in which the refrigerant is recompressed to a point where the temperature thereof reaches approximately 95° C.

6. In a process for refining sugar wherein an aqueous sugar bearing extract of the latter is concentrated to produce a concentrate having a preselected percentage of fixed solids and the sugar is crystallized by boiling a solution thereof using a predeterminable quantity and quality of steam as the source of heat, the improvement which comprises: estimating what proportion of the total amount of water contained in the sugar bearing extract entering the process is needed to satisfy all the sugar boiling requirements of the sugar boiling phase thereof along with at least a part of the process heating requirements upon being evaporated, evaporating and recompressing the excess of the water contained in the sugar bearing extract over and above the total estimated requirements for the sugar boiling phase and that required to satisfy at least a part of the process heating requirements in a recompression evaporator, and evaporating in a single effect evaporator the water contained in said proportion left over after the water contained in the remainder of the sugar bearing extract has been recompressed under conditions capable of producing steam of the quality and in the quantity predetermined as necessary to carry out all of the sugar boiling along with the chosen portion of the process heating.

7. The sugar refining process as set forth in claim 6 which includes the further step of by-passing directly to process heating at least a portion of the steam generated in the single effect evaporator that is in excess of that required for sugar boiling.

8. The sugar refining process as set forth in claim 7 which includes the step of supplementing the heat required for process heating with heat stripped from the vapors generated during sugar boiling.

* * * * *